US010330420B2

(12) United States Patent
Kunsky et al.

(10) Patent No.: US 10,330,420 B2
(45) Date of Patent: Jun. 25, 2019

(54) SUPPRESSOR ASSEMBLY

(71) Applicants: NEMO Arms, Inc., Nampa, ID (US); Gemini Technologies, Eagle, ID (US)

(72) Inventors: Jacob Kunsky, Bruneau, ID (US); Nolan Blake Young, Boise, ID (US)

(73) Assignee: NEMO Arms, Inc., Nampa, ID (US)

( * ) Notice: Subject to any disclaimer, the term of this patent is extended or adjusted under 35 U.S.C. 154(b) by 165 days.

(21) Appl. No.: 15/437,821

(22) Filed: Feb. 21, 2017

(65) Prior Publication Data

US 2018/0238653 A1 Aug. 23, 2018

(51) Int. Cl.

| | |
|---|---|
| ***F41A 21/30*** | (2006.01) |
| ***F41A 21/28*** | (2006.01) |
| ***F41A 5/26*** | (2006.01) |
| ***F41A 21/32*** | (2006.01) |
| *F41A 21/00* | (2006.01) |
| *F01N 3/02* | (2006.01) |
| *F41A 21/34* | (2006.01) |

(52) U.S. Cl.

CPC ..... *F41A 21/325* (2013.01); *F41A 5/26* (2013.01); *F41A 21/30* (2013.01); *F01N 3/02* (2013.01); *F41A 21/34* (2013.01)

(58) Field of Classification Search

CPC ..... F41A 21/325; F41A 21/30; F41A 21/34; F41A 5/26; F41A 3/02; F41A 21/28

See application file for complete search history.

(56) References Cited

U.S. PATENT DOCUMENTS

| | | | | |
|---|---|---|---|---|
| 1,401,667 | A * | 12/1921 | Brown | F41A 3/44 42/70.02 |
| 3,713,362 | A * | 1/1973 | Charron | F41A 21/30 89/14.4 |
| 4,291,610 | A * | 9/1981 | Waiser | F41A 21/30 89/14.4 |
| 4,341,283 | A * | 7/1982 | Mazzanti | F01N 1/06 181/223 |
| 4,530,417 | A | 7/1985 | Daniel | |
| 4,907,488 | A * | 3/1990 | Seberger | F41A 21/30 181/223 |
| 5,164,535 | A | 11/1992 | Leasure | |
| 5,945,626 | A | 8/1999 | Robbins | |
| 6,374,718 | B1 * | 4/2002 | Rescigno | F41A 21/30 89/14.4 |
| 7,600,606 | B2 | 10/2009 | Brittingham | |
| 7,789,008 | B2 * | 9/2010 | Petersen | F41A 21/30 89/14.4 |
| 7,856,914 | B2 | 12/2010 | Shults et al. | |
| 8,100,224 | B1 | 1/2012 | Olson | |

(Continued)

*Primary Examiner* — Edgardo San Martin

(74) *Attorney, Agent, or Firm* — Heslin Rothenberg Farley & Mesiti P.C.

(57) ABSTRACT

A suppressor assembly for a firearm including a barrel, a bore and a muzzle end. The suppressor assembly may include a gas block mount positioned about the barrel, and outer tube configured to be attached to the gas block mount, and a baffle configured to be attached to the muzzle end of the firearm. The baffle is telescopically received and configured to have a clearance fit with the outer tube. The baffle may also include one or more outer edges configured to scrape debris from the inner surface of the outer tube when the baffle is removed from the outer tube.

13 Claims, 7 Drawing Sheets

(56) References Cited

U.S. PATENT DOCUMENTS

| | | | | |
|---|---|---|---|---|
| 8,528,458 | B2 * | 9/2013 | Windauer | F41A 5/28 89/193 |
| 8,567,556 | B2 | 10/2013 | Dueck et al. | |
| 8,596,185 | B1 | 12/2013 | Soong et al. | |
| 8,950,310 | B2 | 2/2015 | Storrs et al. | |
| 9,103,618 | B2 | 8/2015 | Daniel et al. | |
| 9,261,317 | B2 | 2/2016 | Daniel et al. | |
| 9,709,354 | B2 * | 7/2017 | Larue | F41A 21/30 |
| 9,746,267 | B2 * | 8/2017 | Smith | F41A 21/30 |
| 9,835,400 | B2 * | 12/2017 | Barrett | F41A 21/325 |
| 9,879,933 | B2 * | 1/2018 | Myers | F41A 21/48 |
| 2011/0179945 | A1 | 7/2011 | Clark et al. | |
| 2012/0152093 | A1 * | 6/2012 | Koumbis | F41A 21/30 89/14.4 |
| 2014/0157640 | A1 | 6/2014 | Whelan | |
| 2015/0090105 | A1 | 4/2015 | Pace | |
| 2018/0202744 | A1 * | 7/2018 | De Sousa | F41A 21/30 |

* cited by examiner

SUPPRESSOR ASSEMBLY

TECHNICAL FIELD

This invention relates generally to a firearm, and more specifically, to a suppressor assembly for a firearm.

BACKGROUND OF THE INVENTION

Suppressors are attached to a barrel of a firearm and used to, for example, reduce the amount of noise and visible muzzle flash generated by firing. Suppressors reduce noise by allowing the rapidly expanding gases from the firing of the projectile to be decelerated and cooled through a series of hollow chambers. The trapped gas exits the suppressor over a long period of time and at a greatly reduced velocity, producing less noise. Suppressors operate to reduce muzzle blast by reducing and controlling the energy level of the propellant gases accompanying the projectile as it leaves the muzzle end of the firearm. While useful in reducing noise and muzzle flash of a firearm, suppressors may cause unwanted debris to accumulate near the muzzle end of a firearm.

SUMMARY OF THE INVENTION

The shortcomings of the prior art may be alleviated by using a suppressor assembly in accordance with one or more principles of the present invention. The suppressor assembly may be used as, for example, an integral part of a firearm's upper receiver assembly on all centerfire rifles, including, but not limited to, the 223 Remington, the 300 AAC Blackout, the 308 Winchester and the 300 Winchester Magnum. Additionally, other uses may be made of the invention that fall within the scope of the claimed invention but which are not specifically described below.

In one aspect of the invention, there is provided a suppressor assembly attached to a firearm. The firearm includes a barrel, a bore, and a muzzle end. The suppressor assembly comprises a gas block mount, an outer tub and a baffle. The gas block mount is positioned about the barrel and disposed substantially proximal to the muzzle end of the barrel. The outer tube comprises a first end and a second end. The first end of the outer tube is attached to the gas block mount and the second end of the outer tube extends beyond the muzzle end of the firearm. The baffle comprises a first end and a second end. The baffle is telescopically received and configured to have a clearance fit with the outer tube. The first end of the baffle is attached to the muzzle end of the firearm.

In another aspect, the gas block mount defines a chamber with an outer surface of the barrel. This chamber is in communication with the bore of the firearm through one or more ports. In one embodiment, the one or more ports are angled relative to a longitudinal axis of the bore of the firearm. During firing of the firearm, a portion of the projectile gas is directed through these one or more ports into the chamber to pressurize the chamber. This projectile gas is directed back into the bore of the firearm barrel through the one or more ports after pressure in the bore is less than pressure in the chamber.

In another aspect, baffle includes an outer surface comprising one or more edges. The one or more edges are facing and in close proximity to an inner surface of the outer tube. The one or more edges may be configured to scrape debris from the inner surface of said outer tube when said baffle is removed from said outer tube.

Additional features and benefits will become apparent from the following drawings and descriptions of the invention. Other embodiments and aspects of the invention are described in detail herein and are considered a part of the claimed invention.

BRIEF DESCRIPTION OF THE DRAWINGS

The subject matter which is regarded as the invention is particularly pointed out and distinctly claimed in the claims at the end of the specification. The foregoing and other objects, features, and advantages of the invention are apparent from the following detailed description taken in conjunction with the accompanying drawings in which:

DETAILED DESCRIPTION OF EMBODIMENTS OF THE INVENTION

Figure 1:
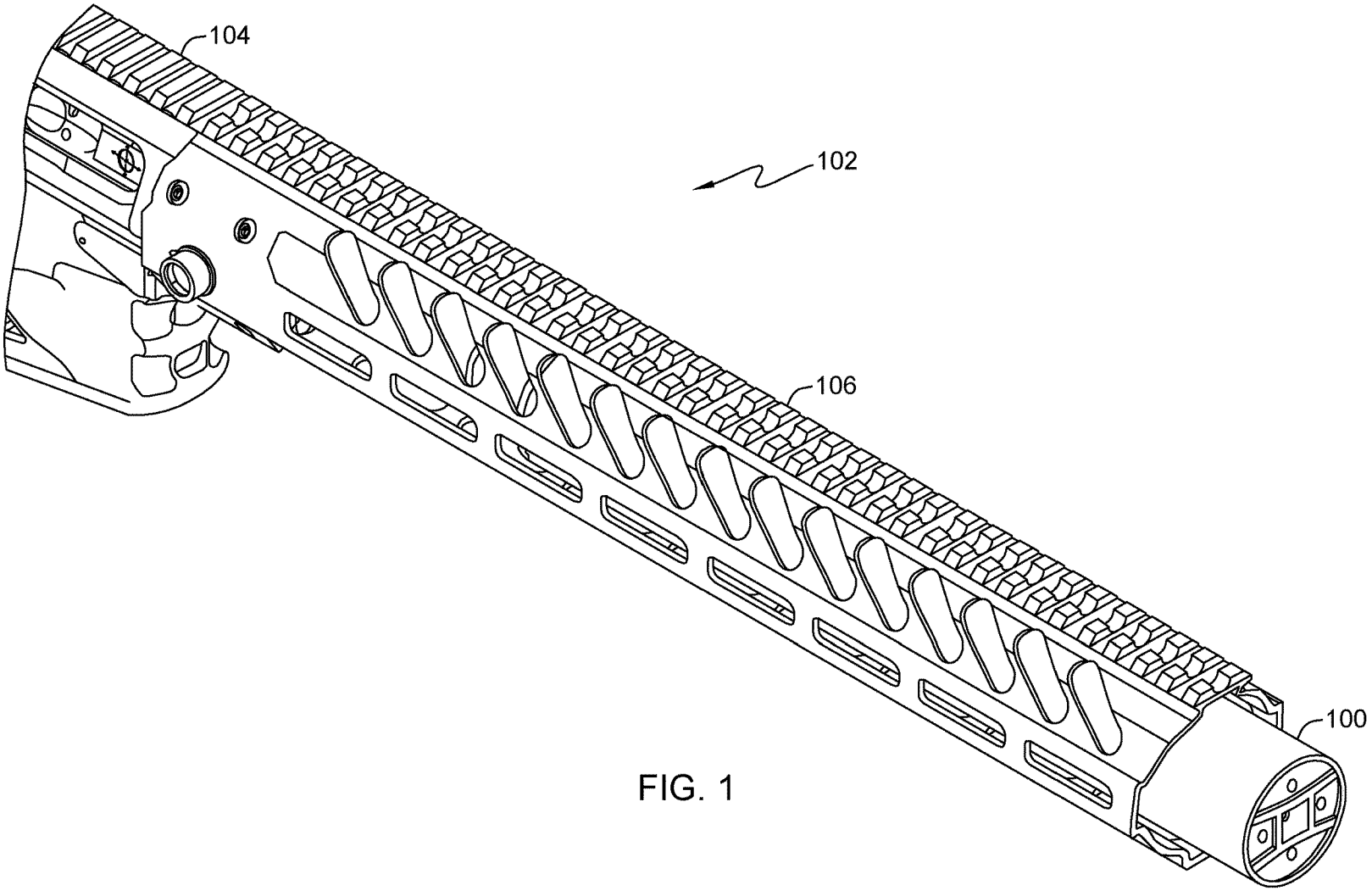
FIG. 1 depicts an upper perspective view of one embodiment of a suppressor assembly attached to a firearm constructed in accordance with one or more aspects of the present invention.

For the purposes of promoting an understanding of the principles of a suppressor assembly designed and constructed in accordance with one or more aspects of the present invention, reference will now be made to the embodiments, or examples, illustrated in the drawings and specific language will be used to describe these examples and embodiments. It will nevertheless be understood that no limitation of the scope of the invention is thereby intended. Any alterations or further modifications in the described embodiments, or any further applications of the principles of the invention as described herein are contemplated as would normally occur to one skilled in the art to which the suppressor assembly invention relates.

Presented herein is an improved suppressor assembly for a firearm. The improved suppressor assembly may be designed to be an integral part of an upper receiver assembly on all centerfire rifles, including, for example, the 223 Remington, the 300 AAC Blackout, the 308 Winchester and the 300 Winchester Magnum. The suppressor assembly is designed so, for example, that the accompanying gases from firing a projectile are diverted into several different chambers in order to reduce, for example, the sound pressure level of the muzzle blast, recoil, muzzle jump, and toxic gases directed back to the shooter.

Conventional suppressor assemblies include a gas block mount mounted to a barrel of a firearm, an outer tube extending beyond a muzzle end of the firearm, and a baffle affixed to or retained within and by the outer tube. An example of a suppressor assembly having this configuration is described in more detail in U.S. Pat. No. 9,103,618 to Daniel Defense, Inc., which is hereby incorporated herein by reference. Current suppressor assembly designs are compromised due to their complexity in assembly and disassembly for cleaning and lacking of any self-cleaning mechanism.

Figure 2:
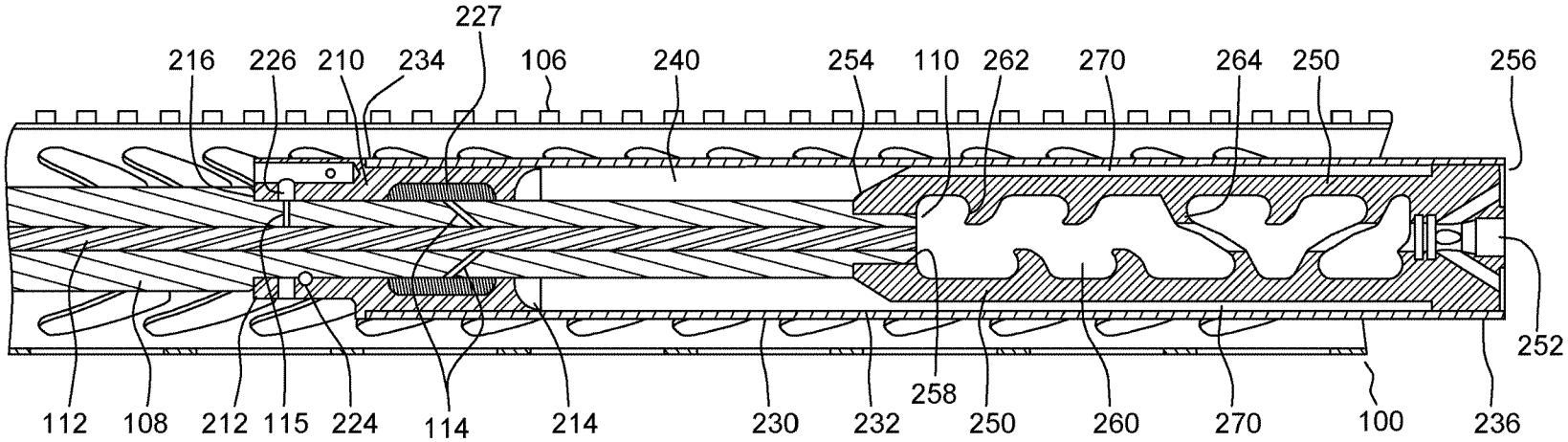
FIG. 2 depicts a side cross section view of one embodiment of a suppressor assembly attached to a firearm constructed in accordance with one or more aspects of the present invention.

In FIGS. 1 and 2, a suppressor assembly 100 constructed in accordance with one or more aspect of the present invention attached to a firearm 102 is illustrated. Firearm 102 may generally include an upper receiver 104 and a hand guard assembly 106. Upper receiver 104 typically houses the internal components of firearm 102. Hand guard assembly 106 extends from upper receiver 104 and about a barrel 108 of firearm 102. Barrel 108 defines a bore 112 having a longitudinal axis for passage of a projectile.

As illustrated in FIG. 2, suppressor assembly 100 includes a gas block mount 210, an outer tube 230 and a baffle 250. Gas block mount 210 is located longitudinally on barrel 108. Gas block mount 210 may be positioned about a barrel 108 of firearm 102 anywhere between a muzzle end 110 and upper receiver 104 of firearm 102. For example, gas block mount 210 may be positioned about barrel 108 at any location between upper receiver 104 and muzzle end 110 of firearm 102.

As illustrated in FIGS. 1-5, gas block mount 210 includes a first end 212, a second end 214, and one or more gas ports 226. In one embodiment, first end 212 of gas block mount 210 contacts a shoulder 216 formed on barrel 108. Barrel shoulder 216 may be designed to be located between the breech (not shown) and muzzle end 110 of barrel 108. The location of shoulder 216 can vary with barrel lengths, cartridge choice or gas operating system such as, for example, a gas-piston system or direct impingement system.

In one embodiment, gas block mount 210 includes three internal bores 218, 220, 222 corresponding with the outer diameter of the barrel 108. In one example depicted in FIGS. 1-5, first bore 218 of gas block mount 210 may be designed to be a clearance fit with the outer diameter of the barrel 108. Second and third internal bores 220, 222 of gas block mount 210 may be designed to be a pressure fit on the outer diameter of the barrel 108. In one example, gas block 210 may be attached rigidly by a set screw 215 that puts vertical force between the outer diameter of barrel 108 and gas block mount 210. A cross-pin 224 may also be utilized to keep gas block mount 210 rigidly attached to barrel 108. Alternatively, gas block mount 210 may be attached to barrel 108 by any means known in the art, such as, but not limited to, welding, screwing, bolting, etc.

Gas block mount 210 may include one or more gas ports 226 in communication with bore 112 of barrel 108 through a gas port 115 formed in barrel 108. In one example, one or more gas port 226 are located so that projectile gases may be diverted from bore 112 of barrel 108, through gas port 115, and into gas block mount 210. This projectile gas may then be diverted rearward to operate the firearm's action. The diverted portion of the propellant gases may be delivered to upper receiver 104 via one or more gas tubes or the like (not shown). On firearms that do not need gas diverted rearward toward the action, bore port 115 may be omitted.

Once gas block mount 210 is attached or secured to barrel 108, a chamber 227 is formed between second and third internal bores 220, 222 of gas block mount 210 and the outer surface of barrel 108. Chamber 227 is in fluid communication with bore 112 of barrel 108 through one or more gas ports 114 formed in barrel 108. In this manner, gas block mount 210 may be configured to divert at least a portion of the propellant gases associated with the firing of the firearm 102 into chamber 227 through one or more gas ports 114. Gas ports 114 may be angled relative to the longitudinal axis of bore 112 of barrel 108.

Figure 3:
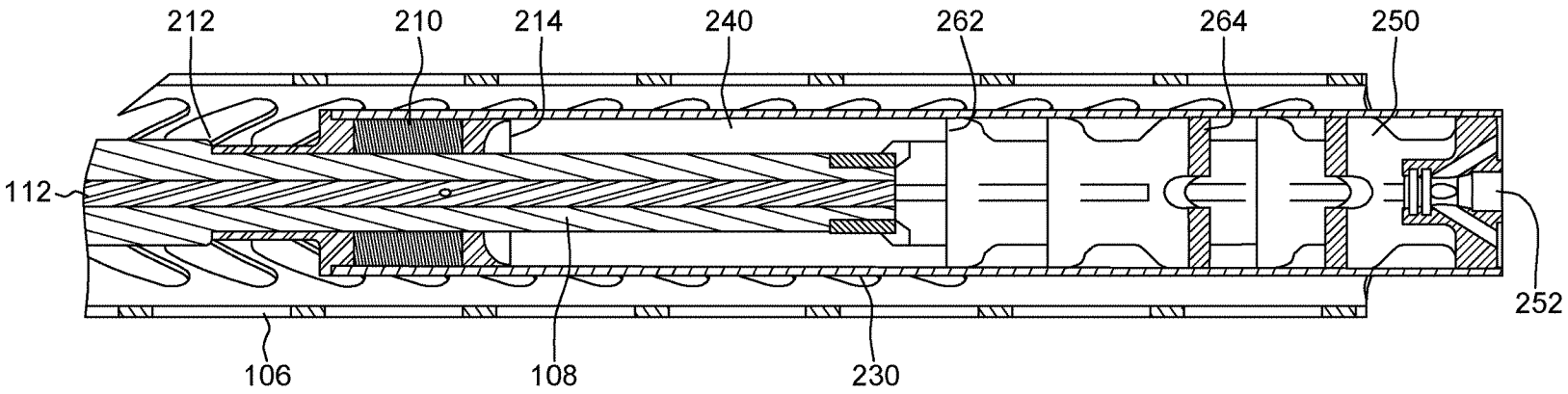
FIG. 3 depicts a bottom cross sectional of the suppressor assembly depicted in FIG. 2.
Figure 5:
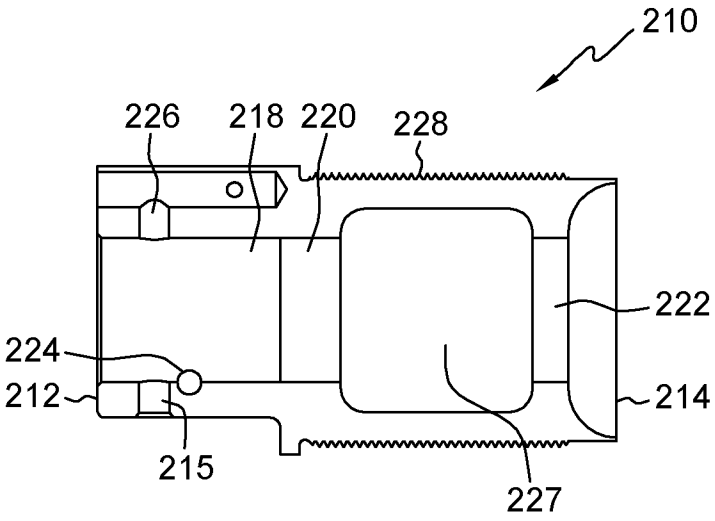
FIG. 5 depicts a side cross sectional view of the gas block mount depicted in FIG. 4.
Figure 4:
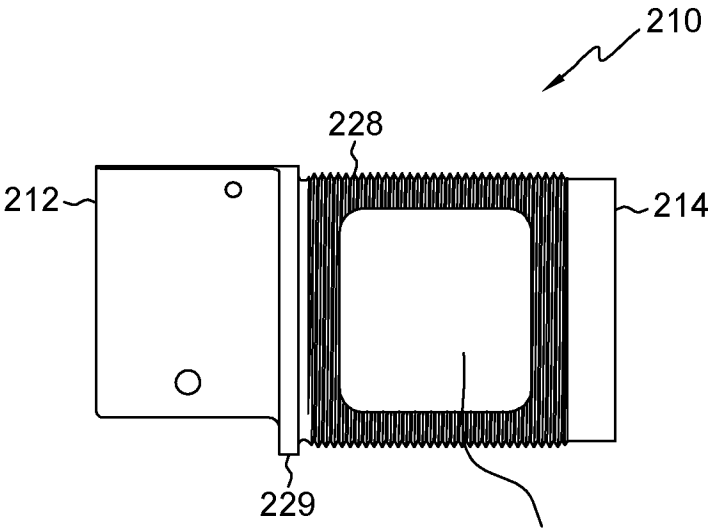
FIG. 4 depicts a side view of one embodiment of a gas block mount constructed in accordance with one or more aspects of the present invention.
Figure 6:
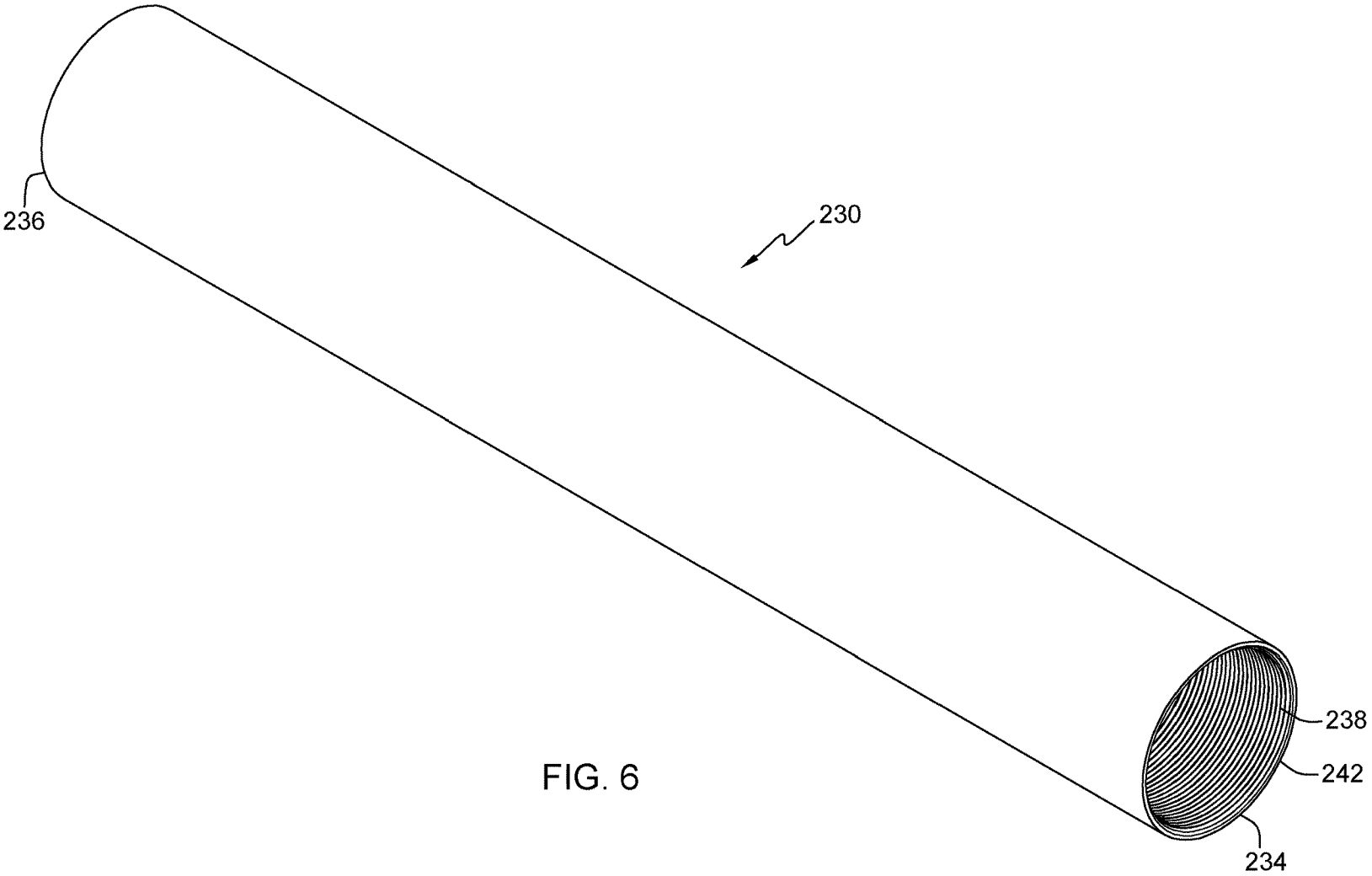
FIG. 6 depicts an upper perspective view of one embodiment of an outer tube constructed in accordance with one or more aspects of the present invention.
Figure 7:
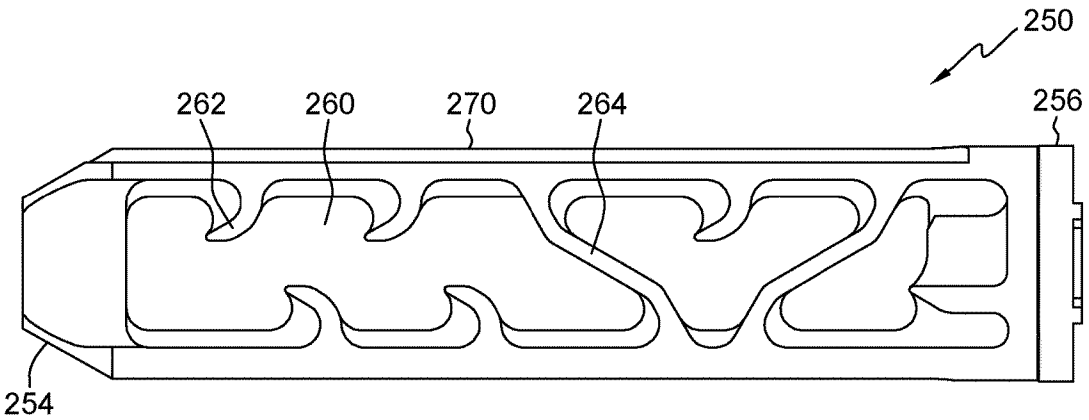
FIG. 7 depicts a side cross sectional view of one embodiment of a baffle constructed in accordance with one or more aspects of the present invention.
Figure 8:
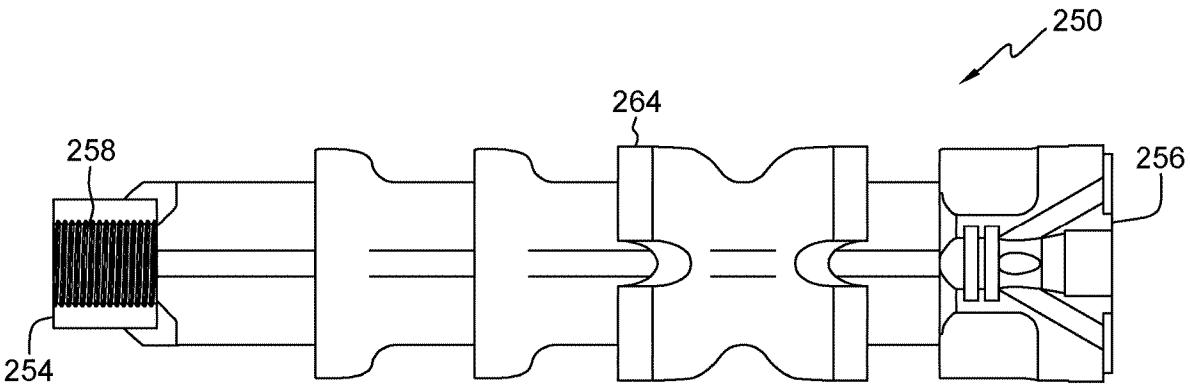
FIG. 8 depicts a top cross sectional view of the baffle depicted in FIG. 7.
Figure 11:
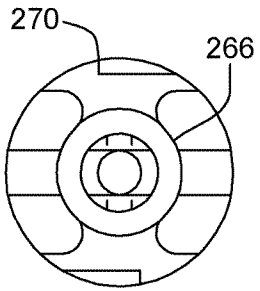
FIG. 11 is a rear view of the baffle depicted in FIG. 7.
Figure 10:
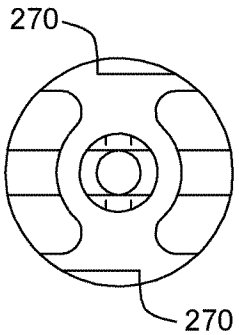
FIG. 10 is a rear cross sectional view of a first end of the baffle depicted in FIG. 7.

As illustrated in FIGS. 2, 3 and 6, outer tube 230 is telescopically received by barrel 108 and attached to gas block mount 210. In one example depicted in FIG. 6, outer tube 230 may include an elongated hollow body 232 having a first end 234 and a second end 236. First end 234 of outer tube 230 may include internal threads 238 that correspond with external threads 228 formed on the outer surface of gas block mount 210. First end 234 of outer tube 230 may be threaded on and tightened against a shoulder 229 formed on the outer surface of gas block mount 210. Alternatively, first end 234 of outer tube 230 may be secured to gas mount block 210 by other known means, such as, for example, welding, pressure fitting, bolting, pins, etc. Once outer tube 230 is attached or secured to gas block mount 210, a chamber 240 is created between end 214 of gas block mount 210, end 254 of baffle 250, the outer diameter of barrel 108, and the internal bore 242 of outer tube 230.

In one embodiment illustrated in FIGS. 2, 3 and 7-8, baffle 250 comprises a single or one-piece baffle that is telescopically received by outer tube 230. Baffle 250 may be machined out of a single piece of metal, ceramic, or other suitable material. Baffle 250 includes a bore 252 extending between a first end 254 and a second end 256. The projectile and the associated propellant gases may pass through bore 252 during firing of the firearm. In this manner, bore 252 of baffle 250 may be substantially aligned with bore 112 of barrel 108. First end 254 of baffle 250 may comprise the entry end of baffle 250 and be configured to receive a projectile and the associated propellant gases exiting muzzle end 110 of the firearm 102. Conversely, second end 256 of baffle 250 may comprise the exit end of baffle 250 and be configured to expel the projectile and the associated propellant gases from baffle 250.

Figure 9:
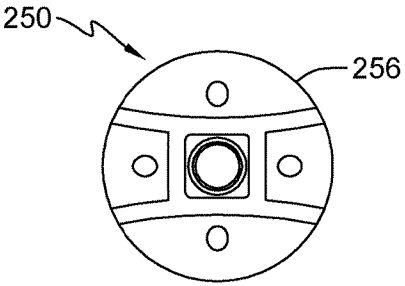
FIG. 9 depicts a front view of the baffle depicted in FIG. 7.
Figure 12:
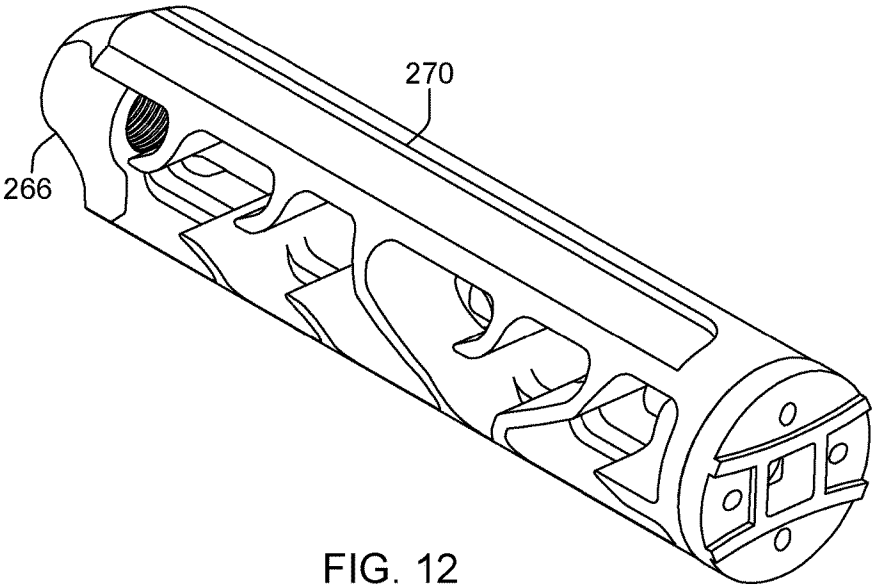
FIG. 12 is a upper perspective view of the baffle depicted in FIG. 7.

First end 254 of baffle 250 may be configured to attach by, for example, external threads on muzzle end 110 of barrel 108 corresponding to internal threads 258 formed on bore 252 near first end 254 of baffle 250. In one example, baffle 250 may tighten on or against a front face of another shoulder formed on the outer surface of barrel 108. Baffle 250 may be designed to have a clearance fit between the outer diameter of baffle 250 and internal bore of outer tube 230 so that baffle 250 can be screwed in and out of outer tube 230 without interference by outer tube 230. Once baffle 250 is tightened into place on muzzle end 110 of firearm 102, internal and external baffle chambers 260 are created by voids in baffle 250 and the internal bore of the outer tube 230 and the outer diameter of barrel 108. In one example illustrated in FIG. 9, second end 256 of baffle 250 may be configured so that baffle 250 can be tightened or loosened to barrel 108 with a tool, such as, for example a ⅜ inch drive ratchet.

In one embodiment, second end 256 of baffle 250 extends beyond muzzle end 110 of firearm 102 the same distance as second end 236 of the outer tube 230. Alternatively, second end 256 of baffle 250 may be configured to be extend shorter or longer than the distance that second end 236 of outer tube 230 extends beyond muzzle end 110 of firearm 102. In accordance with one or more aspects of the present invention, second end 256 of baffle 250 and second end 236 of outer tube 230 are not attached together. By not attaching second end 256 of baffle 250 to second end 236 of outer tube 230, baffle 250 may be easily removable from outer tube 230 for maintenance and cleaning of firearm 102 and suppressor assembly 100.

FIGS. 7-12 illustrate one configuration of a baffle that may be used with a suppressor assembly constructed in accordance with one or more aspects of the present invention. In this example, baffle 250 includes a series of baffle fins 262 and baffle ribs 264. First end 254 of baffle 250 may include one or more radial cuts 266 to allow propellant gasses to enter chamber 240 behind the muzzle created by the inner bore of the outer tube 230, the outer diameter of the barrel 108, second end 214 of the gas block mount 210, and the first baffle rib. If radial cuts 266 were not present, the initial baffle chamber would be defined from muzzle end 110 to the first baffle rib. As the projectile continues through bore 252 of baffle 250, the baffle ribs and baffle chambers act on the propellant gasses to reduce muzzle blast, recoil, and muzzle jump. As the projectile passes out second end 256 of baffle 250, projectile gasses are directed into two cylindrical grooves as well as four angled ports to help reduce flash created by the burning propellant gasses.

Baffle 250 includes an outer surface facing an inner surface of outer tube 230. In one embodiment, baffle 250 may include one or more edges 270 extending longitudinally along outer surface of baffle 250. Edges 270 may protrude from outer surface or be formed by, for example, an indentation or longitudinal cut or groove in outer surface. In another example, edges 270 may be spaced longitudinally along outer surface of baffle 250, or form a corkscrew pattern around outer surface of baffle 250. Edges 270 provide a cleaning mechanism for the interior bore or surface of outer tube 230. In this example, as baffle 250 is unscrewed from external threads on muzzle end 110 of barrel 108, one or more edges 270 act to scrape and/or clean carbon fouling or other debris from or off the interior bore or surface of outer tube 230 during removal of baffle 250 from muzzle end 110 and outer tube 230. As baffle 250 is being unscrewed and removed from muzzle end 110 and outer tube 230, edge(s) 270 pass in close proximity to the inner surface of outer tube 230 and work to scrape, knock off and/or collect debris that may accumulate on the inner surface of outer tube 230 during firing of firearm 102.

In one example of firing a rifle that includes a suppressor assembly 100 constructed in accordance with one or more aspects of the present invention, the projectile goes down bore 112 of the barrel 108. As the projectile passes bore port 226, a portion of the projectile gasses are directed into gas ports 226 of gas block mount 210 in order to be redirected to the firearm's action for semi-automatic cycling. This is commonly accomplished by a gas-piston system or by directly sending the gasses rearward to impinge on the action. The use of the suppressor assembly constructed in accordance with one or more principles of the present invention is not dependent on bore gasses being redirected rearward to the action for semi or fully automatic function. By omitting the bore port on the barrel, the system can be used on manual operation firearms like bolt action, pump action, or lever action firearms.

As the projectile continues down bore 112 and passes the angled bore ports 114, another portion of projectile gas is directed through angled bore ports 114 into chamber 227 thereby pressurizing the chamber. These gasses are directed back into the bore through the angled ports 114 after the pressure in bore 112 is less than the pressure in chamber 227. The gasses pressurized in chamber 227 may release back into bore 112 after the projectile has passed second end 256 of baffle 250. Once the gasses escape from pressurized chamber 227, they enter bore 112 at high velocity and angled appropriately relative to the bore axis so as to jet towards the muzzle end. The high velocity jet of gas inclines the remaining propellant gasses in the bore and baffle chambers to exit out the muzzled end of the barrel and consequently the second end of the baffle rather than escaping out the breech of the barrel and towards the shooter. The chamber volume, port sizes, number of ports, and angle of ports relative to the axis of the bore can all be varied with barrel length, gas block mount location, cartridge, and baffle type.

As the projectile passes muzzle end 110 of the barrel 108, projectile gasses will escape from barrel bore 112 into interior and exterior baffle chambers. In one example of a suppressor assembly constructed in accordance with one or more aspects of the present invention, the initial baffle chamber extends from the second end of gas block mount 210 to the first baffle rib forward of muzzle end 110. Propellant gasses are directed rearward towards second end 214 of gas block mount 210 and into chamber 240 created by the interior bore of outer tube 230 and outer diameter of barrel 108 via the baffle fins and baffle ribs. Radial cuts 266 in first end 254 of baffle 250 allow propellant gasses to enter chamber 240 behind the muzzle created by the inner bore of the outer tube 230, the outer diameter of the barrel 108, second end 214 of the gas block mount 210, and the first baffle rib. If radial cuts 266 not present, the initial baffle chamber would be defined from muzzle end 110 to the first baffle rib. As the projectile continues through bore 252 of baffle 250, the baffle ribs and baffle chambers act on the propellant gasses to reduce muzzle blast, recoil, and muzzle jump. As the projectile passes out second end 256 of baffle 250, projectile gasses are directed into two cylindrical grooves as well as four angled ports to help reduce flash created by the burning propellant gasses.

While embodiments of the invention have been illustrated and described in detail in the disclosure, the disclosure is to be considered as illustrative and not restrictive in character. All changes and modifications that come within the spirit of the invention are to be considered within the scope of the disclosure.

The invention claimed is:

1. A suppressor assembly attached to a firearm, the firearm including a barrel, a bore, and a muzzle end, the suppressor assembly comprising:

a gas block mount positioned about the barrel and disposed substantially proximal to the muzzle end of the barrel;

an outer tube, said outer tube comprising a first end and a second end, the first end of said outer tube attached to the gas block mount, the second end of said outer tube extending beyond the muzzle end of the firearm;

a baffle comprising a first end and a second end, said baffle telescopically received and configured to have a clearance fit with said outer tube, the first end of the baffle attached to the muzzle end of the firearm.

2. The suppressor assembly of claim 1, wherein said baffle includes an outer surface comprising one or more edges, the one or more edges facing and in close proximity to an inner surface of said outer tube.

3. The suppressor assembly of claim 2, wherein the one or more edges extend longitudinally along the outer surface of said baffle.

4. The suppressor assembly of claim 2, wherein the one or more edges are configured to scrape debris from the inner surface of said outer tube when said baffle is removed from said outer tube.

5. The suppressor assembly of claim 1, wherein the first end of said baffle is screwed over the muzzle end of the firearm.

6. The suppressor assembly of claim 1, wherein the first end of said outer tube is screwed over a portion of said gas block mount.

7. The suppressor assembly of claim 1, wherein said baffle is secured against a shoulder formed on an outer surface of the barrel proximate the muzzle end of the firearm.

8. The suppressor assembly of claim 1, wherein said gas block mount defines a chamber with an outer surface of the barrel, the chamber of said gas block mount in communication with the bore of the firearm through one or more ports.

9. The suppressor assembly of claim 8, wherein a portion of projectile gas created during firing of the firearm is directed through the one or more ports into the chamber to pressurize the chamber.

10. The suppressor assembly of claim 9, wherein the portion of projectile gas directed into the chamber during firing of the firearm is directed back into the bore through the one or more ports after pressure in the bore is less than pressure in the chamber.

11. The suppressor assembly of claim 8, wherein the one or more ports are angled relative to a longitudinal axis of the bore of the firearm.

12. The suppressor assembly of claim 1, wherein said outer tube extends along the length of said baffle.

13. The suppressor assembly of claim 1, wherein the second end of said outer tube and the second end of said baffle extend axially the same distance beyond the muzzle end of the firearm.

* * * * *